US006488224B1

(12) United States Patent
Hiebenthal

(10) Patent No.: US 6,488,224 B1
(45) Date of Patent: Dec. 3, 2002

(54) SPRING REEL RETRACTION SPEED GOVERNOR

(75) Inventor: Benjamin B. Hiebenthal, Herman, NE (US)

(73) Assignee: Insul-8 Corporation, Omaha, NE (US)

( * ) Notice: Subject to any disclaimer, the term of this patent is extended or adjusted under 35 U.S.C. 154(b) by 0 days.

(21) Appl. No.: 09/862,106

(22) Filed: May 21, 2001

(51) Int. Cl.[7] ..... B65H 75/30; B65H 75/48
(52) U.S. Cl. ..... 242/381
(58) Field of Search ..... 242/381, 381.5, 242/396; 182/233, 238

(56) References Cited

U.S. PATENT DOCUMENTS

| | | | | | |
|---|---|---|---|---|---|
| 2,521,178 | A | | 9/1950 | Melitti | |
| 2,954,190 | A | * | 9/1960 | Le Clair | 242/396 |
| 2,991,024 | A | * | 7/1961 | Goode | 242/396 |
| 4,018,423 | A | * | 4/1977 | Belew | 242/396 |
| 4,446,884 | A | * | 5/1984 | Rader | 242/381 |
| 4,452,430 | A | * | 6/1984 | Kankkunen | 242/396 |
| 4,554,997 | A | | 11/1985 | Sheu | 182/238 |
| 5,135,181 | A | | 8/1992 | Wesselink | |
| 5,277,282 | A | | 1/1994 | Umemura | 188/290 |
| 5,373,921 | A | | 12/1994 | Muscatell | 188/292 |
| 5,494,133 | A | | 2/1996 | Green et al. | 182/238 |
| 5,586,617 | A | | 12/1996 | England et al. | 182/238 |
| 5,826,679 | A | * | 10/1998 | Chern | 182/233 |
| 6,086,007 | A | * | 7/2000 | Till | 242/381 |
| 6,234,417 | B1 | * | 5/2001 | Sauder et al. | 242/381 |

* cited by examiner

*Primary Examiner*—John M. Jillions
(74) *Attorney, Agent, or Firm*—Thomte, Mazour & Niebergall; Dennis L. Thomte

(57) ABSTRACT

A hydraulic braking mechanism or governor is mounted on a spring-loaded reel for controlling the rate of rotation of the reel as the elongated member which is wound upon the wheel is being rewound thereon.

17 Claims, 7 Drawing Sheets

SPRING REEL RETRACTION SPEED GOVERNOR

BACKGROUND OF THE INVENTION

1. Field of the Invention

This invention relates to a spring-loaded reel or spring reel and more particularly to a spring reel retraction speed governor.

2. Description of the Related Art

Hoses and electrical cords are frequently wound upon a spring-loaded reel. When it is desired to use the hose or electrical cord, the hose or cord is pulled from the reel against the action of a spring. When the hose or reel has been pulled to its desired extended position, the spring-loaded reels normally employ a latching system to maintain the hose or cord in the extended position. When it is desired to rewind or retract the hose or cord, the hose or cord is pulled outwardly a small amount to disengage the latching system. The spring-loaded reel then rewinds the hose or cord thereon due to the spring causing the retraction rotation of the reel. In the event that the operator should lose his grip on the hose or cord as it is being rewound by the spring associated with the reel, the hose or cord could strike a person or object causing damage to the person or object as well as damage to the equipment associated with the hose or cord. When the hose or cord is in its extended position, the latching mechanism sometimes becomes disengaged which causes the spring-loaded reel to rapidly rewind the hose or cord upon the reel which may also result in the hose or cord striking a person or object as explained above.

It is believed that attempts have been made to solve the problems outlined above through the use of mechanical governors or the like in an attempt to control the retraction speed of the hose or cord. However, it is believed that the mechanical governors are subject to failure and are quite complicated and expensive.

SUMMARY OF THE INVENTION

A governor or hydraulic brake mechanism is described for use with a spring-loaded reel or spring reel as it is sometimes called. The reel is adapted to have a hose or electrical cord wound thereon. For purposes of description, the spring-loaded reel will be described as a cord reel having an electrical cord wound thereon. The spring-loaded reel is rotatably mounted on a cord reel support. As the cord is pulled or unwound from the reel, the conventional spring associated with the reel resists the rotation of the reel as the spring is wound. The governor or braking mechanism of this invention comprises a hydraulic gear pump which is mounted on the reel support and which includes an internal hydraulic circuit consisting of a variable metering valve which is used to control the free retraction speed of the spring-powered rewind reel. The hydraulic gear pump is driven via a changeable ratio drive. The metering or restricting valve can be adjusted to reduce the flow of fluid through the valve. The restricted flow causes a resistance to rotation of the pump shaft of the hydraulic pump causing a braking force on the spring reel. The braking force is proportional to the rotational speed of the reel which causes the reel to reach a maximum desired speed, which can be set by the operator of the spring reel. Limiting the retraction rate of the reel makes the reel much safer to operate, eliminating most of the dangers associated with prior art designs.

It is therefore a principal object of the invention to provide a governor or braking mechanism for a spring-powered cable or hose rewind reel.

A further object of the invention is to provide a selectively adjustable hydraulic braking mechanism which is used to control the free retraction speed of a spring-powered cable or hose rewind reel.

Still another object of the invention is to provide a governor or hydraulic braking mechanism which is readily adaptable to conventional spring-powered hose or cable reels.

These and other objects will be apparent to those skilled in the art.

DESCRIPTION OF THE PREFERRED EMBODIMENT

Figure 1:
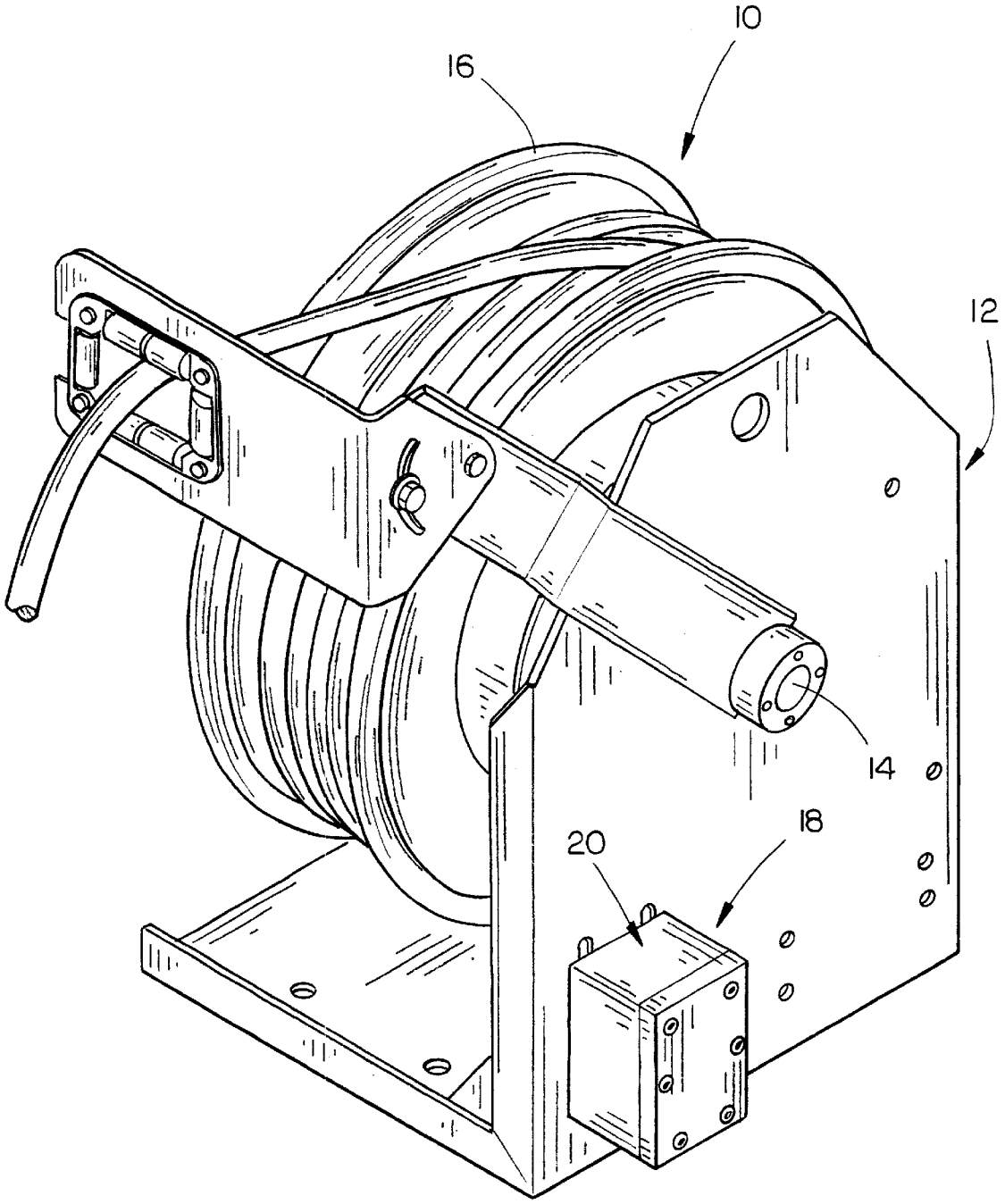
FIG. 1 is a perspective view of a spring reel having the retraction speed governor of this invention mounted thereon.
Figure 3:
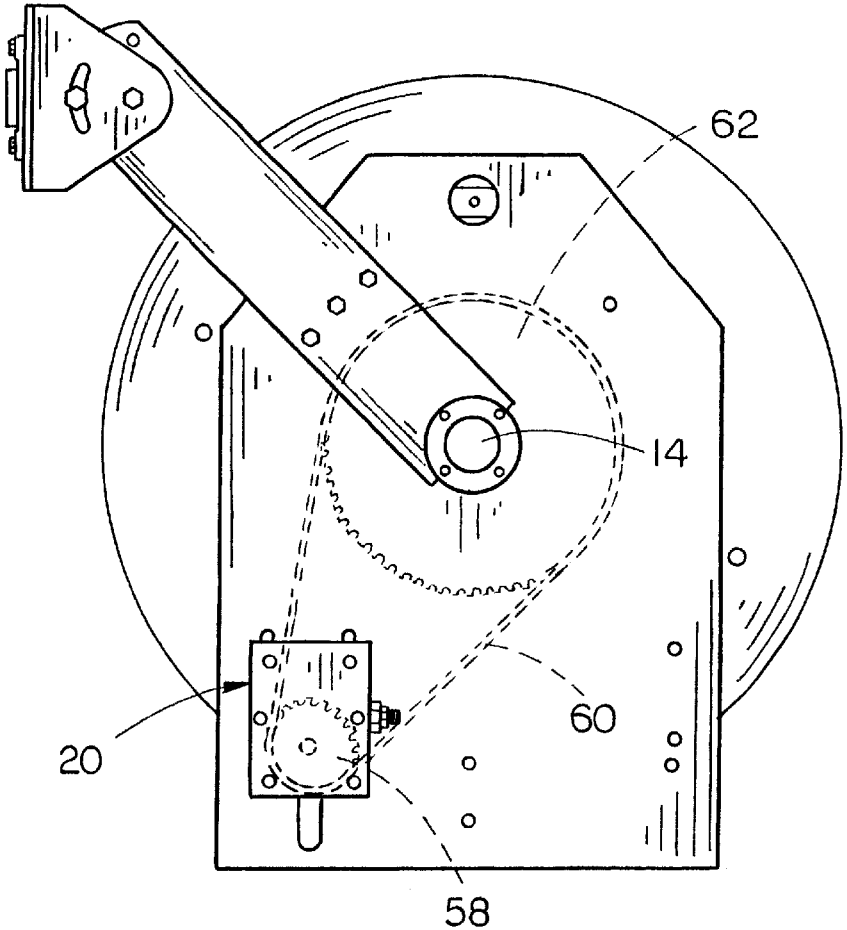
FIG. 3 is a side elevational view of the apparatus of FIG. 2.
Figure 2:
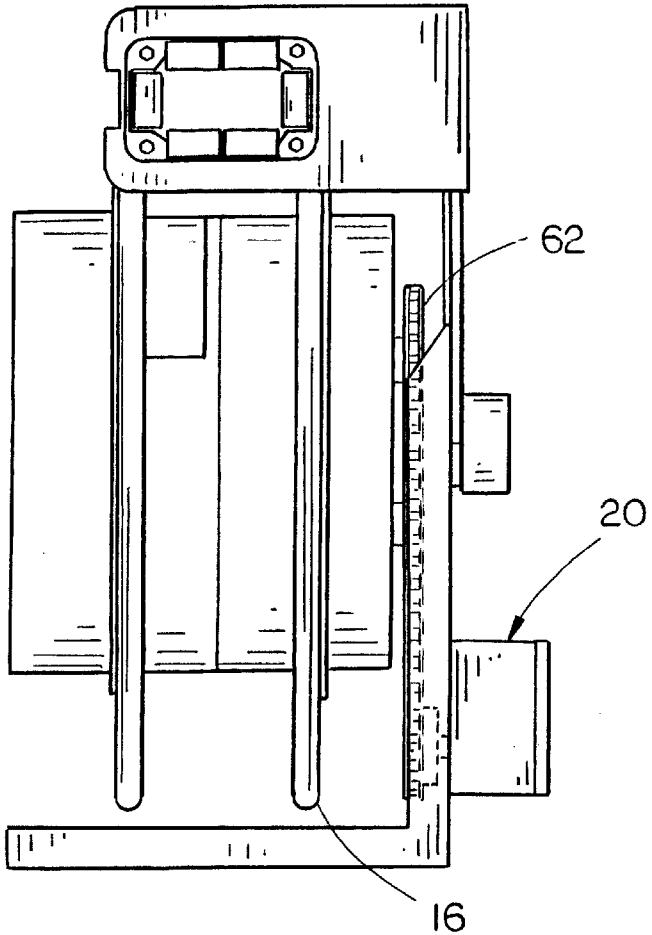
FIG. 2 is an end elevational view of the apparatus of FIG. 1.
Figure 4:
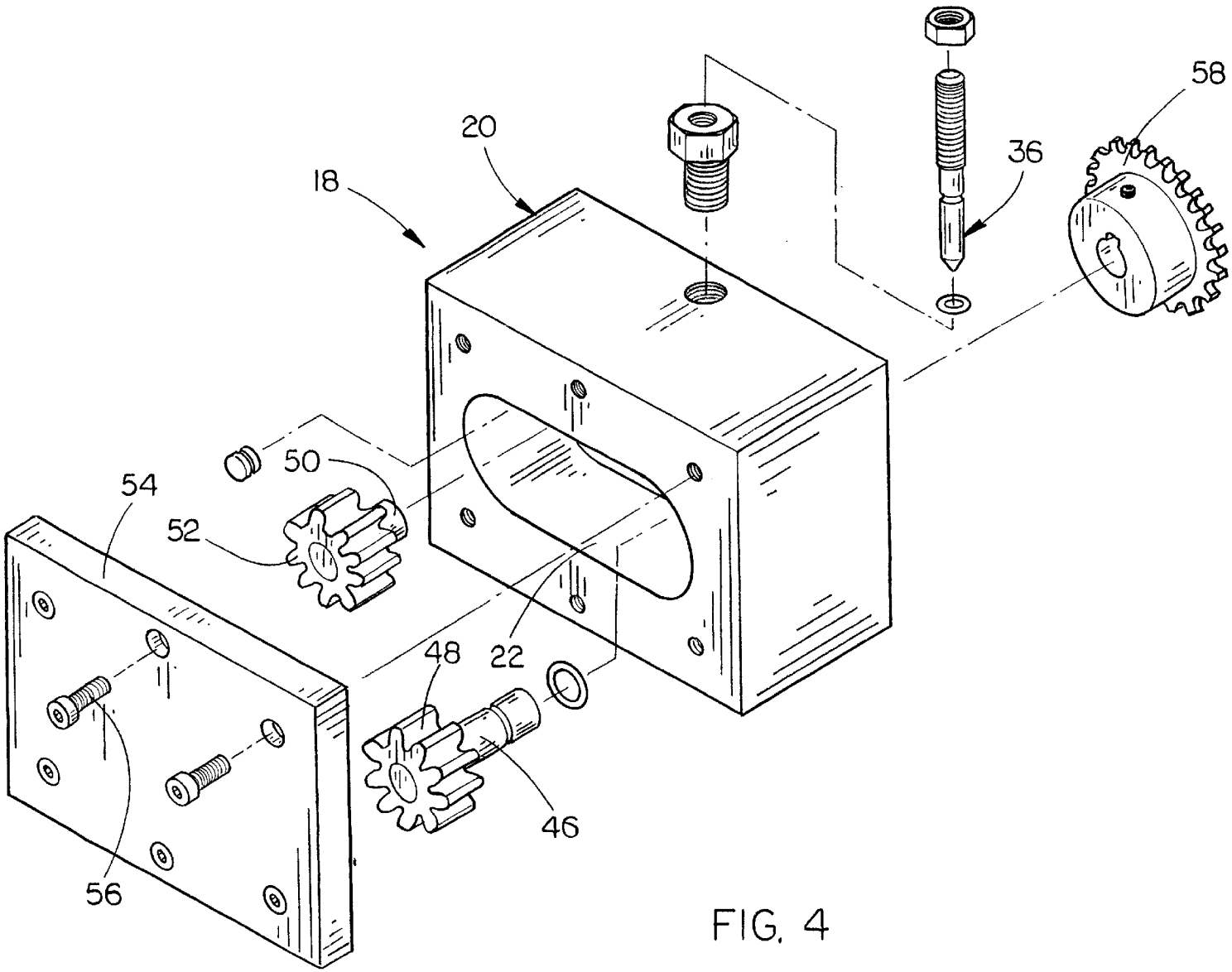
FIG. 4 is an exploded perspective view of the governor of this invention.

Referring to the drawings, the numeral 10 refers generally to a generally conventional spring-loaded or spring-powered rewind reel. Although the rewind reel will be described as comprising an electrical cable rewind wheel, it should be understood that the rewind reel 10 could also be used to rewind hoses or the like. If the rewind reel 10 is used for rewinding an electrical cable thereon, the rewind reel will include a conventional collector ring apparatus.

Reel 10 includes a reel support 12 having a shaft or axle 14 rotatably mounted thereon. A flanged reel member 16 is mounted on the shaft or axle 14 for rotation therewith. The reel 10 includes a conventional spring rewind apparatus, the spring of which is wound as the cable is unwound from the reel member 16. The reel 10 also includes conventional latching means for selectively latching the reel member 16 when the electrical cable has been unwound a predetermined amount from the reel member 16. To this point, the description of the reel 10 describes conventional structure. It is to this structure that the hydraulic braking mechanism or governor 18 is employed to control the free retraction speed of the reel member during the rewinding process should the operator lose his grip on the cable or should the latching mechanism become inadvertently disengaged which would normally cause the cable to be rewound on the reel member 16 at a high rate of speed. The rewinding at a high rate of speed could cause damage to the cable and accessories mounted thereon in addition to the possible injury that could occur to persons in the vicinity of the rapidly retracting cable.

Figure 10:
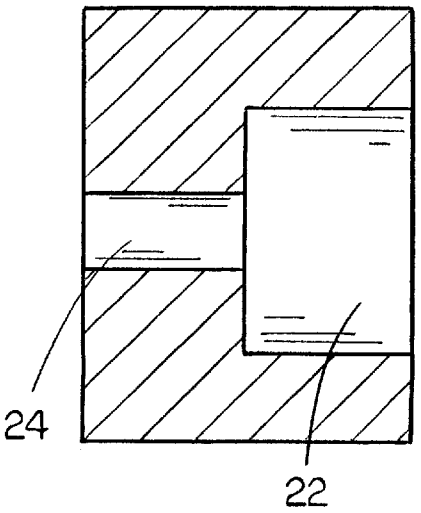
FIG. 10 is a sectional view seen on lines 10—10 of FIG. 8.
Figure 9:
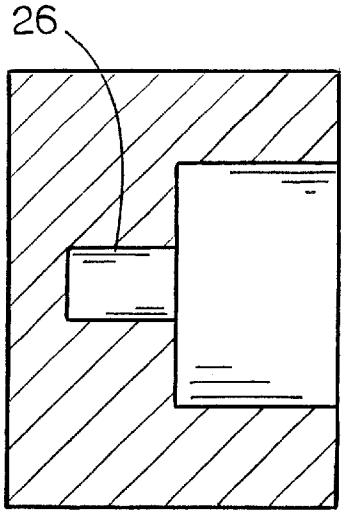
FIG. 9 is a sectional view seen on lines 9—9 of FIG. 8.
Figure 8:
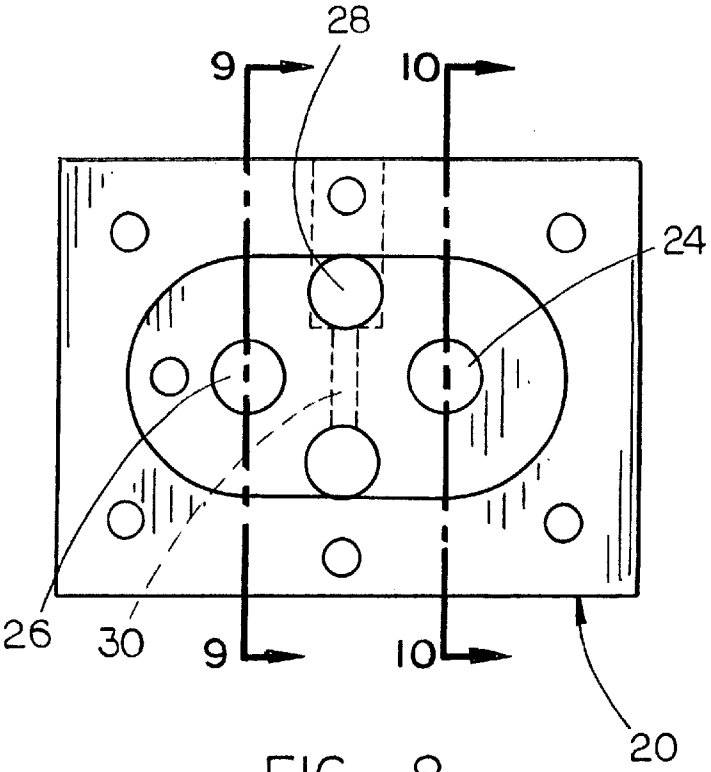
FIG. 8 is a side view of the body with the cover plate removed.

Hydraulic braking mechanism 18 includes a body 20 having a generally oblong-shaped fluid cavity or compartment 22 formed therein which is filled with hydraulic fluid. Bore 24 extends from the cavity 22 outwardly through the body 20, as seen in FIG. 10. As seen in FIG. 10, bore 24 is formed in body 20 adjacent one end of the cavity 22 and extends through the body 20. As seen in FIG. 9, a bore 26 is formed in body 20 and extends from cavity 22 and terminates short of the end of the body 20.

Figure 5:
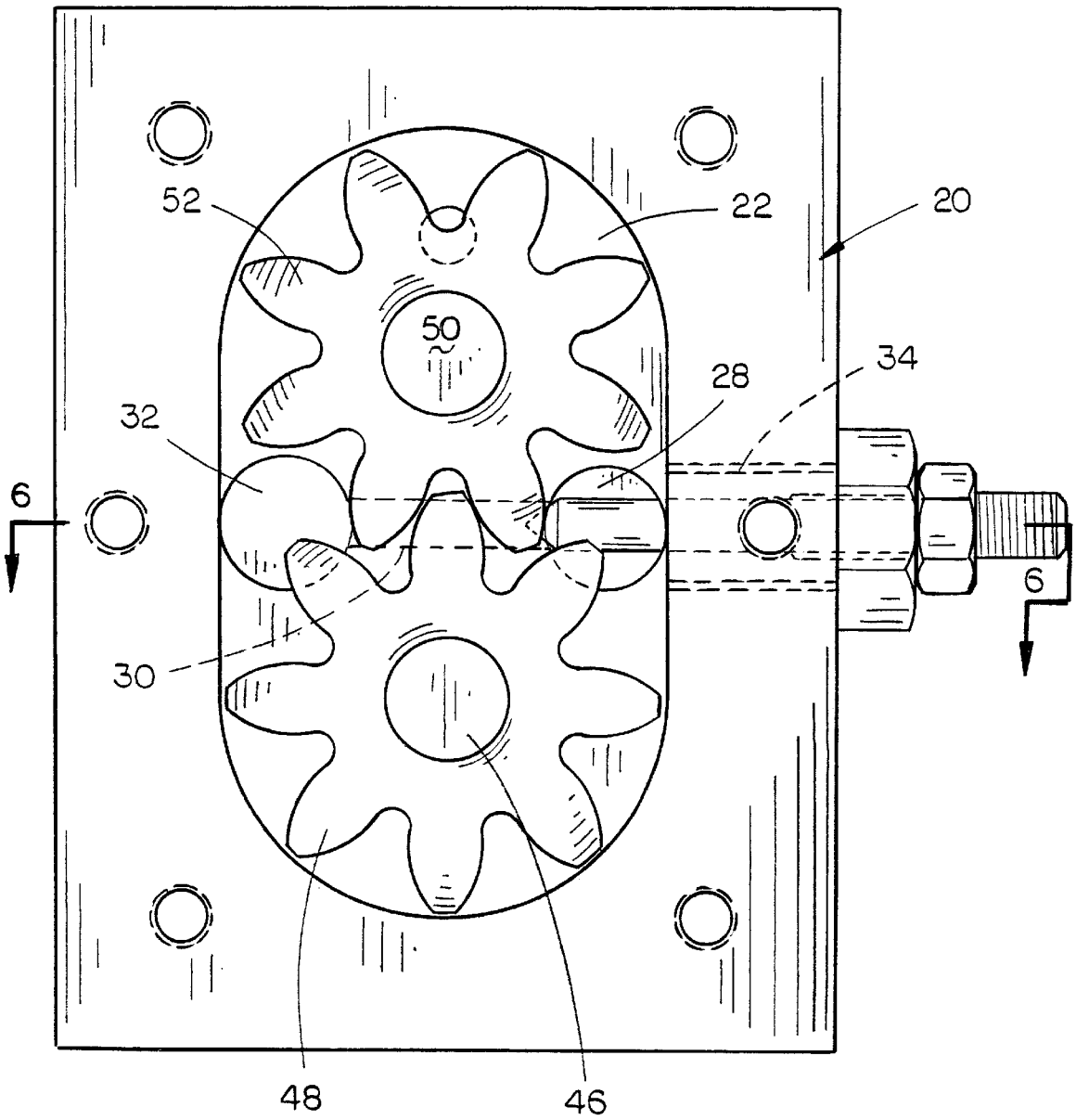
FIG. 5 is a side elevational view of the governor with portions thereof removed to more fully illustrate the invention.

An inlet port 28 extends from cavity 22 to a passageway 30 formed in the body 20. Passageway 30 communicates with an outlet port 32 which extends to the cavity 22. An internally threaded bore 34 is formed in the body 20, as seen in FIG. 5, and communicates with the inner end of inlet port 28 and the passageway 30. Internally threaded bore 34 has a needle bushing 36 threadably mounted therein which has a metering needle 38 threadably mounted therein. The inner end 40 of needle 38 is adapted to engage the end of passageway 30 which serves a valve seat. Needle 38 includes an annular groove 42 formed therein having an O-ring 44 mounted therein. Adjustment of the needle 38 with respect to the passageway 30 permits the variable restriction of flow through the passageway 30.

Pump shaft 46 extends through bore 24 and has a gear or impeller 48 mounted on one end thereof which is rotatably positioned in cavity 22. Shaft 50 is rotatably mounted in bore 26 and has gear or impeller 52 mounted thereon. As seen in FIG. 5, the teeth of the impellers 48 and 52 mesh between the inlet port 28 and outlet port 32. Cavity 22 is sealed by means of a cover plate 54 which is secured to body 20 by screws 56.

Figure 6:
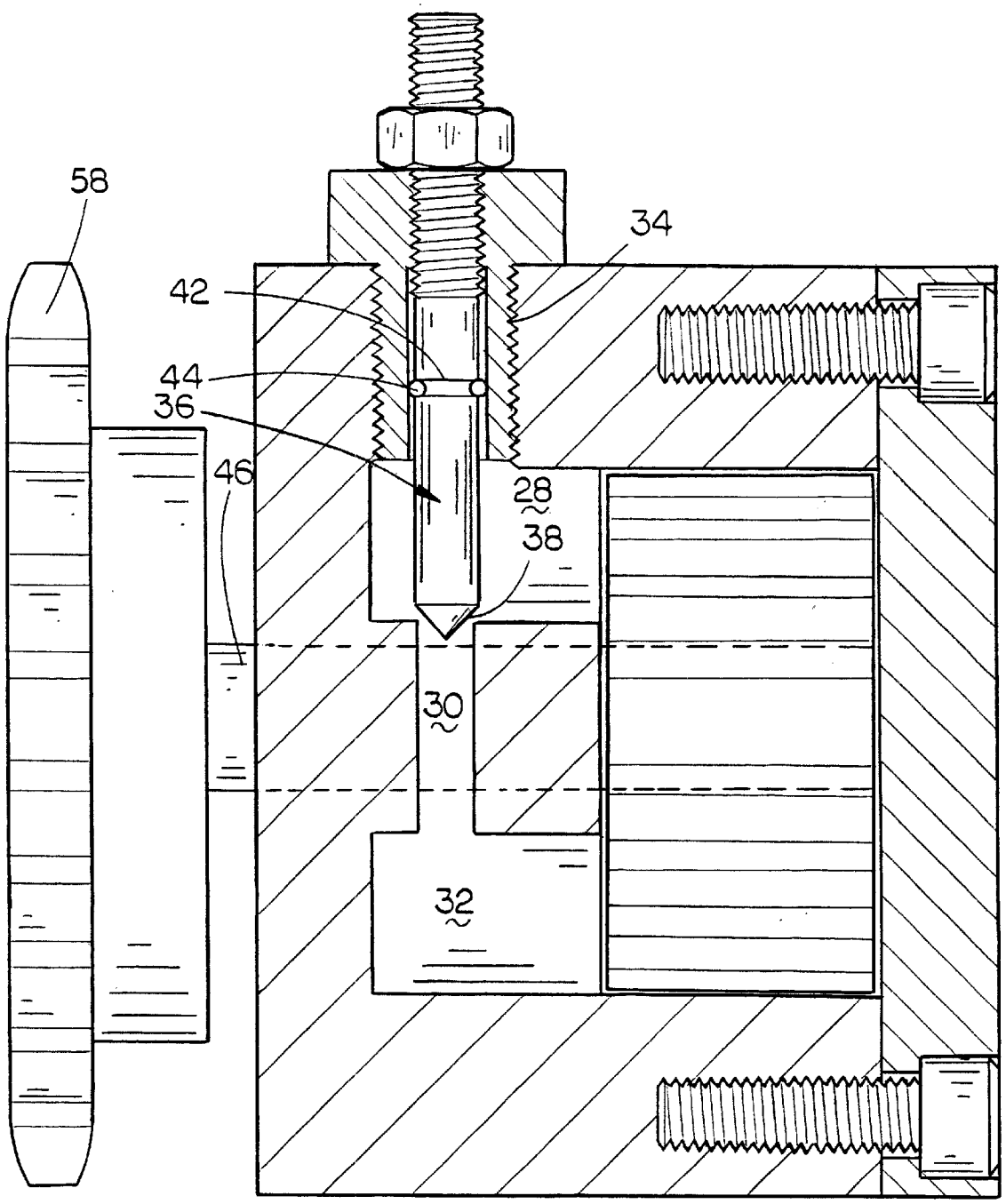
FIG. 6 is a sectional view as seen on lines 6—6 of FIG. 5.
Figure 7:
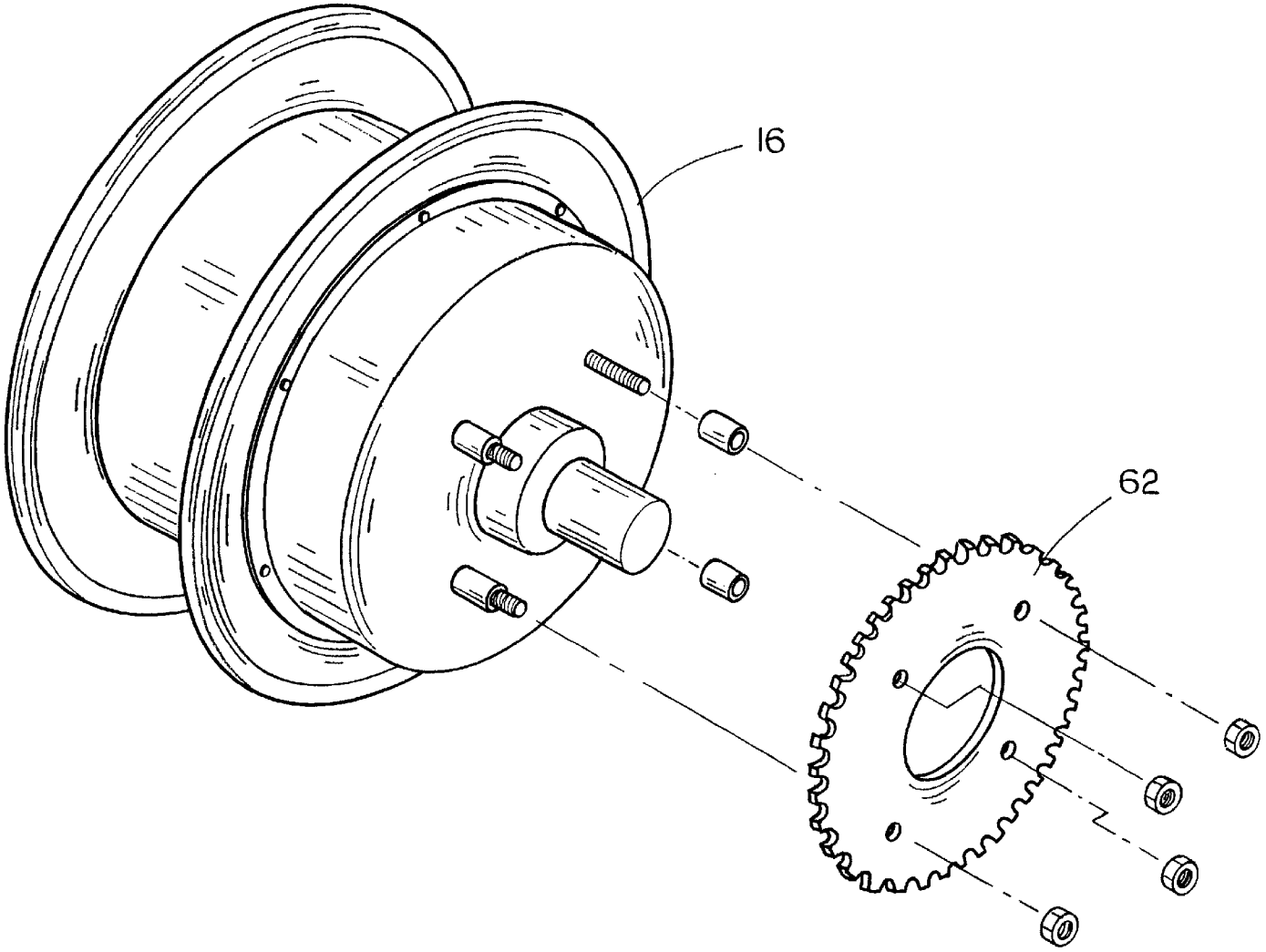
FIG. 7 is a partial exploded perspective view which illustrates the manner which the drive sprocket is connected to the spring reel.

Sprocket 58 is mounted on the outer end of pump shaft 46, as seen in FIG. 6, and has a chain 60 extending therearound. Sprocket 62 is directly mounted on reel member 16, in the manner illustrated in FIG. 7, for rotation therewith and has the chain 60 extending therearound.

The restricting valve or needle 38 can be adjusted to reduce the flow of fluid through the passageway 30. The restricted flow causes a resistance to rotation of the pump shaft 46 causing a braking force on the spring reel through the sprocket 58, chain 60 and sprocket 62. This braking force is proportional to the rotational speed of the reel. This causes the reel to reach a maximum desired speed, which can be set by the operator of the spring reel. Limiting the retraction rate of the reel makes the reel much safer to operate, eliminating most of the dangers associated with the prior art spring reels. The braking mechanism is easily installed on existing spring reels or may be included as original equipment on the spring reels.

In order to permit the freewheeling of the reel during the unwinding step, it is preferred that a clutch bearing which is free-rolling in one direction be utilized on the pump shaft 46.

Thus it can be seen that the invention accomplishes at least all of its stated objectives.

I claim:

1. In combination:

a cable reel support;

a spring-loaded cable reel rotatably mounted on said cable reel support;

a cable wound upon said cable reel which may be manually pulled from said cable reel against the spring action of said spring-loaded cable reel to a locked extended position and which may be rewound upon said cable reel by the spring action of said spring-loaded cable reel when said cable reel has been moved to an unlocked position;

a hydraulic braking mechanism removably operatively connected to said cable reel for controlling the rate of rotation of said cable reel as said cable is rewound upon said cable reel;

a first sprocket mounted on said cable reel for rotation therewith;

a first shaft rotatably mounted on said cable reel support;

a second sprocket mounted on said first shaft;

and a chain extending around said first and second sprockets; said hydraulic braking mechanism being operatively connected to said shaft.

2. The combination of claim 1 wherein said hydraulic braking mechanism comprises a body mounted on said cable reel support which has a fluid chamber formed therein which has an inlet port and an outlet port in communication therewith; a first rotatable impeller positioned in said fluid chamber; a second rotatable impeller positioned in said fluid chamber which meshes with said first impeller for rotation therewith; said shaft being operatively connected to one of said first and second impellers for rotation therewith; said body having a fluid passageway formed therein which fluidly connects said inlet and outlet ports; the rotation of said first shaft causing said impellers to force fluid from said fluid chamber into said outlet port, through said fluid passageway, and thence into said fluid chamber via said inlet port.

3. The combination of claim 2 further including flow restriction means in said fluid passageway.

4. The combination of claim 3 wherein said flow restriction means is adjustable.

5. The combination of claim 3 wherein said flow restriction means comprises an adjustable needle valve.

6. In combination:

a support;

a spring-loaded reel rotatably mounted on said support;

an elongated, flexible member wound upon said reel which may be manually pulled from said reel against the spring action of said spring-loaded reel to an extended position and which may be rewound upon said reel by the spring action of said spring-loaded reel;

a hydraulic braking mechanism removably operatively connected to said reel for controlling the rate of rotation of said reel as said elongated member is rewound upon said reel;

a first sprocket mounted on said reel for rotation therewith;

a first shaft rotatably mounted on said support;

a second sprocket mounted on said first shaft;

and a chain extending around said first and second sprockets; said hydraulic braking mechanism being operatively connected to said first shaft.

7. The combination of claim 6 wherein said hydraulic braking mechanism comprises a body mounted on said support which has a fluid chamber formed therein which has an inlet port and an outlet port in communication therewith; a first rotatable impeller positioned in said fluid chamber; a second rotatable impeller positioned in said fluid chamber which meshes with said first impeller for rotation therewith; said first shaft being operatively connected to one of said first and second impellers for rotation therewith; said body having a fluid passageway formed therein which fluidly connects said inlet and outlet ports; the rotation of said first shaft causing said impellers to force fluid from said fluid chamber into said outlet port, through said fluid passageway, and thence into said fluid chamber via said inlet port.

8. The combination of claim 7 further including flow restriction means in said fluid passageway.

9. The combination of claim 8 wherein said flow restriction means is adjustable.

10. The combination of claim 8 wherein said flow restriction means comprises an adjustable needle valve.

11. In combination:

a cable reel support;

a spring-loaded cable reel rotatably mounted on said cable reel support;

a cable wound upon said cable reel which may be manually pulled from said cable reel against the spring action of said spring-loaded cable reel to a locked extended position and which may be rewound upon said cable reel by the spring action of said spring-loaded cable reel when said cable reel has been moved to an unlocked position;

a hydraulic braking mechanism for controlling the rate of rotation of said cable reel as said cable is rewound upon said cable reel comprising: a body which has a fluid chamber formed therein which has an inlet port and an outlet port in communication therewith; a first rotatable impeller positioned in said fluid chamber; a second rotatable impeller positioned in said fluid chamber which meshes with said first impeller for rotation therewith; a shaft being operatively connected to one of said first and second impellers for rotation therewith; said body having a fluid passageway formed therein which fluidly connects said inlet and outlet ports; a selectively secured needle valve positioned in said fluid passageway for adjustably restricting the flow of said fluid between said inlet and outlet ports; the rotation of said shaft causing said impellers to force fluid from said fluid chamber into said outlet port, through said fluid passageway, and thence into said fluid chamber via said inlet port.

12. The combination of claim 11 further comprising: a first sprocket mounted on said cable reel for rotation therewith; a second sprocket mounted on said shaft; and a chain extending around said first and second sprockets.

13. The combination of claim 11 wherein said shaft is rotatably mounted on said cable reel support; said cable reel being mounted on said shaft for rotation therewith.

14. In combination:

a support;

a spring-loaded reel rotatably mounted on said support;

an elongated, flexible member wound upon said reel which may be manually pulled from said reel against the spring action of said spring-loaded reel to an extended position and which may be rewound upon said reel by the spring action of said spring-loaded reel;

a hydraulic braking mechanism for controlling the rate of rotation of said reel as said elongated member is rewound upon said reel comprising: a body which has a fluid chamber formed therein which has an inlet port and an outlet port in communication therewith; a first rotatable impeller positioned in said fluid chamber; a second rotatable impeller positioned in said fluid chamber which meshes with said first impeller for rotation therewith; a shaft being operatively connected to one of said first and second impellers for rotation therewith; said body having a fluid passageway formed therein which fluidly connects said inlet and outlet ports; a selectively secured needle valve positioned in said fluid passageway for adjustably restricting the flow of said fluid between said inlet and outlet ports; the rotation of said shaft causing said impellers to force fluid from said fluid chamber into said outlet port, through said fluid passageway, and thence into said fluid chamber via said inlet port.

15. The combination of claim 14 further comprising: a first sprocket mounted on said reel for rotation therewith; a second sprocket mounted on said shaft; and a chain extending around said first and second sprockets.

16. The combination of claim 14 wherein said shaft is rotatably mounted on said reel support; said reel being mounted on said shaft for rotation therewith.

17. The combination of claim 14 wherein said elongated member comprises an electric end.

* * * * *